US006378590B1

(12) United States Patent
Allen et al.

(10) Patent No.: US 6,378,590 B1
(45) Date of Patent: Apr. 30, 2002

(54) HOT GAS LABEL APPLICATOR

(75) Inventors: George Allen, Irvine, CA (US); Michael F. Golaszewski, Easton, PA (US)

(73) Assignee: Label-Aire, Inc., Fullerton, CA (US)

( * ) Notice: Subject to any disclaimer, the term of this patent is extended or adjusted under 35 U.S.C. 154(b) by 0 days.

(21) Appl. No.: 09/116,557

(22) Filed: Jul. 15, 1998

(51) Int. Cl.[7] ..... B65C 9/00; B65C 9/06; B65C 9/16; B65C 9/26

(52) U.S. Cl. ..... 156/542; 156/541; 156/499; 156/556; 156/DIG. 33; 156/DIG. 37

(58) Field of Search ..... 156/541, 542, 156/DIG. 28, DIG. 33, DIG. 36, DIG. 37, DIG. 38, DIG. 51, DIG. 21, 540, 499, 497, 556

(56) References Cited

U.S. PATENT DOCUMENTS

| | | | | | |
|---|---|---|---|---|---|
| 3,159,521 | A | * | 12/1964 | Pechmann | 156/499 |
| 3,291,675 | A | * | 12/1966 | Orloff et al. | 156/499 |
| 3,450,590 | A | * | 6/1969 | La Mers | 156/540 |
| 3,782,889 | A | * | 1/1974 | Panico | 432/59 |
| 4,025,382 | A | * | 5/1977 | Del Rosso | 156/497 |
| 4,124,429 | A | | 11/1978 | Crankshaw | |
| 4,210,484 | A | | 7/1980 | Crankshaw | |
| 4,255,220 | A | | 3/1981 | Kucheck et al. | |
| 4,314,869 | A | | 2/1982 | Crankshaw | |
| 4,318,384 | A | * | 3/1982 | Moffett | 123/557 |
| 4,337,108 | A | | 6/1982 | Crankshaw et al. | |
| 4,367,118 | A | * | 1/1983 | Karp | 156/497 |
| 4,566,933 | A | | 1/1986 | Crankshaw et al. | |
| 4,612,079 | A | | 9/1986 | Ostrow | |
| 4,830,701 | A | | 5/1989 | Crankshaw et al. | |
| 4,844,771 | A | | 7/1989 | Crankshaw et al. | |
| 5,022,954 | A | * | 6/1991 | Plaessmann | 156/542 |
| 5,470,420 | A | | 11/1995 | Yokajty | |
| 5,472,543 | A | | 12/1995 | Yokajty | |
| 5,605,597 | A | * | 2/1997 | Plenzler | 156/499 |

* cited by examiner

*Primary Examiner*—Richard Crispino
*Assistant Examiner*—Sue A. Purvis
(74) *Attorney, Agent, or Firm*—Stout, Uxa, Buyan & Mullins, LLP; Donald E. Stout

(57) ABSTRACT

An apparatus and associated method for applying labels having a pressure sensitive adhesive on at least one face to articles. The label applicator includes a supporting structure supporting a label dispenser having a peeler bar and a label receiver. The label dispenser is adapted to remove labels from a backing strip and transfer the labels to the label receiver. The peeler bar is configured with an integral heater to heat each label as the label is passed over the peeler bar. A hot gas dispenser is attached to the label dispenser and is used to dispense a flow of heated air against the label to soften the adhesive on each label as the label is passed from the label dispenser to the label receiver. The label receiver is adapted to releasably retain the label and transfer the label onto a surface on the article.

17 Claims, 2 Drawing Sheets

HOT GAS LABEL APPLICATOR

This application is related to U.S. Pat. No. 5,853,530, issued Dec. 29, 1998, and entitled IMPROVED LABEL APPLICATOR and to U.S. patent application Ser. No.08/827,943, filed Apr. 11, 1997, and entitled LABEL APPLICATOR, now abandoned, all of which are commonly assigned and the contents of which are expressly incorporated herein by reference.

FIELD OF THE INVENTION

This invention relates generally to label applicators and more particularly, to a label applicator having a hot gas dispenser for applying modem adhesive backed labels to articles.

BACKGROUND OF THE INVENTION

In a typical conventional label applicator, labels having one face coated with a pressure sensitive adhesive are removed, one at a time, from a carrier web or backing strip. The labels are then transferred or otherwise supplied to a label receiver or grid. Each label is releasably retained against the label receiver by vacuum pressure applied to the inner face of the label receiver and/or by pressurized air blown against the adhesive coated surface.

When an article to be labeled reaches an appropriate position at a labeling station, a blast of air is passed through passages in the label receiver. The blast of air pushes against the label and transfers the label from the label receiver to the surface of the article. This transfer may take place after moving the label receiver and the retained label adjacent the article. The pressure sensitive adhesive adheres the label to the article. Label applicators of this general type are shown in commonly assigned U.S. Pat. No. 4,255,220, issued to Kucheck et al., and U.S. Pat. No. 4,844,771, issued to Crankshaw et al.

The typical conventional label applicator as described above is satisfactory for many labeling applications and with many types and styles of labels. However, recent advances in the design and manufacturing of labels and their adhesive backings has led to major changes in the types and styles of labels used. In particular, differing labels, including newly developed security and source tags, may have different size, weight, thickness, and adhesive characteristics that are not generally compatible with the currently available label applicators. Furthermore, for applications located in an area having cooler ambient temperatures, where the product to be labeled and/or the source tags may be quite cool, these cool conditions also often have a deleterious effect on the label adhesive, causing an even greater problem of improper adhesion of the tags to the product.

In addition to adapting to the newer labels, modem label applications often require increased production demands or labeling speeds. This may be particularly true when applying labels to smaller packages which have a quick flowthrough speed. However, merely increasing the labeling speed of these prior art label applicators often results in poor production output. Specifically, labels may be improperly adhered to the surface of the article because at the increased production speeds, the tag tends to "jet" or "bounce" off of the product to be labeled, resulting in misplacement or even falling off of a substantial number of labels or tags. The newer contact adhesives used on these modem labels may also compound this problem.

Thus, there is a need for a label applicator which can effectively and accurately apply modem labels and do so at increased labeling speeds. There is also need for an apparatus and method which can be used alone or as a modification to existing conventional label applicators such that they are compatible with and can accurately apply these newer labels and do so at increased production speeds.

There is a need for such an apparatus to be simple to install and relatively inexpensive.

SUMMARY

The present invention satisfies the need for a label applicator that can effectively and accurately apply modem labels to articles and do so with increased production speeds. The present invention satisfies this need by providing a label applicator having a hot gas dispenser which heats the adhesive layer on each label prior to placement on the article. This application of a hot gas against the labels, just prior to their placement on the article, softens the adhesive layer and increases their ability to adhere to the articles.

In particular, the pressure sensitive adhesive applied to most modern labels typically requires a certain minimum application pressure or force to securely adhere each label to the surface of the article. If the application force is not sufficient or is not properly applied, the label may not be properly adhered to the article. In addition, the increased labeling speed of modem applications often requires a tackier adhesive to ensure proper adhesion to the article at production speeds. Heating of the adhesive layer softens the adhesive and promotes the adhesion of the label to the article. This reduces the concern that the label has not been properly adhered.

The present invention is generally directed to a label applicator for removing a label from an elongated backing or carrier strip and for applying the label to a surface on an article. The label applicator is generally configured with an outer housing or supporting structure. A label receiver is movably mounted to the supporting structure and includes a label receiving face for releasably retaining the label. The label receiving face is adapted to transfer the label to the desired surface on the article.

A label dispenser is attached to the supporting structure and is adapted for removing at least one label from the backing strip and for transferring the label onto the label receiving face. The label dispenser includes a peeler bar having a peeler plate or peeling surface and a peeling edge over which the backing strip can be drawn. Movement of the backing strip over the peeling edge peels or otherwise removes the label from the backing strip.

A hot gas dispenser is also attached to the supporting structure and is fluidly connected with a supply of a pressurized gas such as compressed air. The hot gas dispenser is adapted for heating and directing a flow of the gas against the label as the label is transferred off of the peeler bar and onto the label receiver face.

The hot gas dispenser includes an electrical resistance heater for heating the gas. A length of tubing interconnects the heater with the supply of pressurized gas and also with a nozzle. The nozzle is adapted for discharging the heated gas against the label as the label is transferred onto the label receiving face.

In another aspect of the present invention, the label applicator of the present invention includes a peeler bar heater for heating the peeling surface. The peeler bar heater is coupled to the peeler bar and disposed adjacent and underneath the peeling surface. The heater is energized or otherwise activated when the label is passed over the peeling surface to actively transfer heat into the adhesive.

In yet another aspect of the present invention, the label applicator further includes a second gas dispenser. This second gas dispenser is attached to the supporting structure such that a flow of a pressurized second gas is also directed against the label. This flow of the second gas is used to assist in transferring the label from the label dispenser and onto the label receiving face.

The second gas dispenser is spaced apart from the peeler bar and on a side opposite to the hot gas dispenser. The second gas is directed against the upper and rear surfaces of each label as the label is transferred off of the label dispenser. The second gas dispenser includes a second nozzle which is connected with a supply of a pressurized second gas such as compressed air. The second nozzle is oriented on top of, and behind, the label as it is removed from the backing strip. This location and orientation allows the flow of the compressed air to assist in the transfer of the label onto the label receiver.

A preferred method for applying a label having an adhesive on at least one face to a surface on an article according to the principles of the present invention comprises providing a label applicator, such as the label applicator of the present invention. In particular, the method comprises the step of providing a label applicator having a label dispenser with a peeler bar and a hot gas dispenser. The label dispenser is configured for removing labels from their backing strip and for transferring the labels, one at a time, to a label receiver. The hot gas dispenser is attached to the label dispenser adjacent the peeler bar and is adapted to warm the adhesive on the label.

The method also includes the step of supplying at least one of the labels to the label dispenser. The label is typically supplied as a plurality of spaced apart labels on a backing strip as previously described. The supplied label is then removed from the backing strip and dispensed from the label dispenser onto the label receiver.

The label dispenser may also be provided with a peeler bar having a peeling surface and a peeling edge as previously described and wherein the step of dispensing the label comprises slidably moving a backing strip supporting the labels across the peeling surface and over the peeling edge to sequentially remove the labels, one at a time, from the backing strip.

A flow of a hot gas is dispensed from the hot gas dispenser against the label as the label is transferred from the label dispenser to the label receiver. The heat from the hot gas softens the adhesive on the label face. After the label is transferred to the label receiver, a blast of a pressurized air is applied through the label receiver and against the label. This blast of air removes the label from the label receiver and transfers the label to the surface of the article.

In yet another aspect of the present invention, the method includes the step of heating the peeling surface. In particular, the peeling surface is heated as the backing strip is moved across the peeling surface and the label is removed. This heat is transferred through the backing strip and into the adhesive layer to heat and thus, soften the adhesive layer. An electrical resistance heater element is coupled to the peeler bar for providing heat to the peeling surface. The resistance heater element is of a generally low heat output to prevent the adhesive layer from becoming too soft or even actually melting.

The invention, together with additional features and advantages thereof, may be best understood by reference to the following description taken in conjunction with the accompanying illustrative drawings. In these accompanying drawings, like reference numerals designate like parts throughout the figures.

DESCRIPTION OF THE PREFERRED EMBODIMENTS

Figure 1:
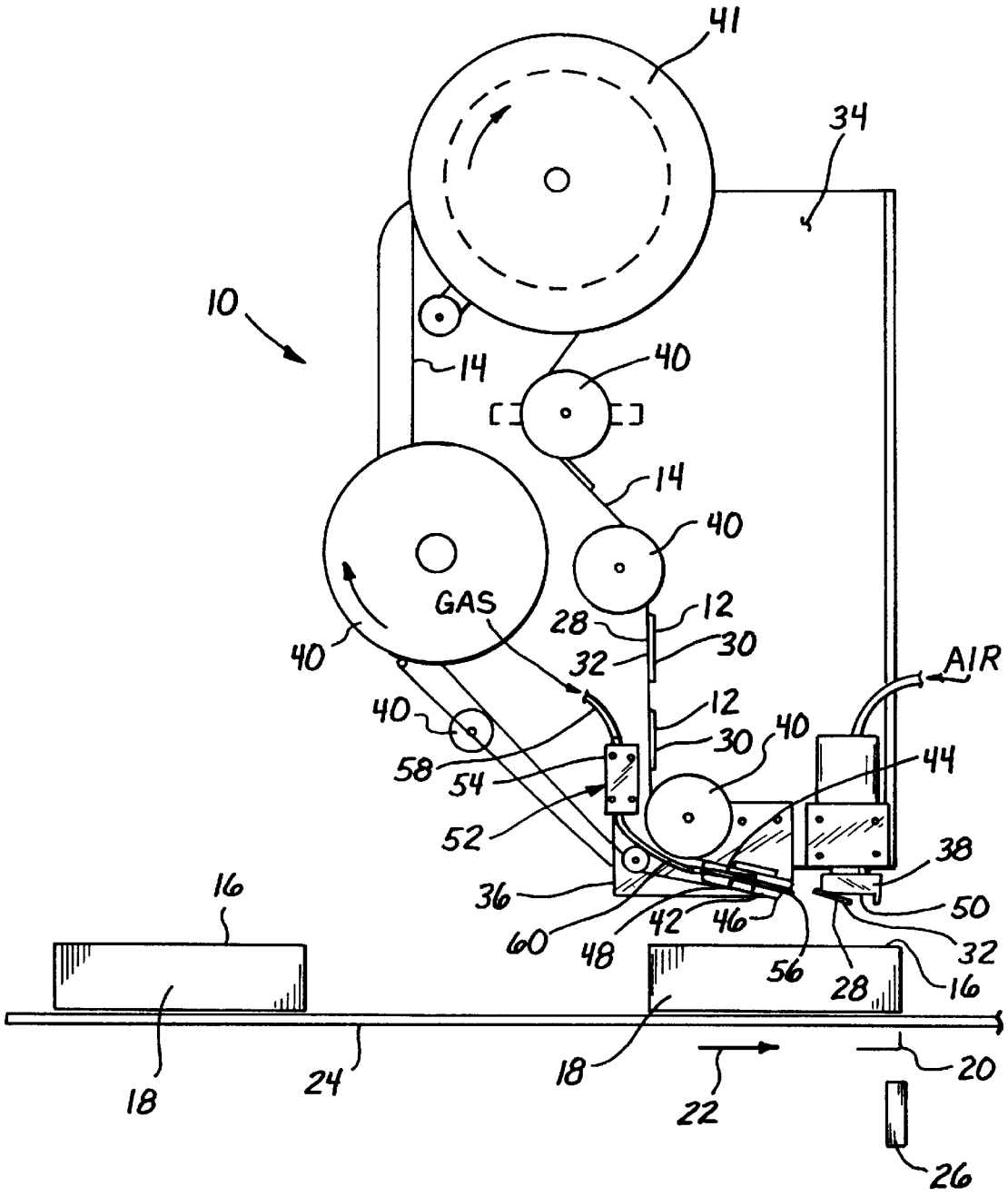
FIG. 1 is a side view of an embodiment of a label applicator having the features of the present invention.

Referring now to the drawings, wherein like reference numerals designate identical or corresponding parts throughout the several views and embodiments, a hot air label applicator according to the principles of the present invention is illustrated in FIG. 1 and designated by reference numeral 10. As shown, the hot air label applicator 10 may be used to remove labels 12, one at a time, from a web or backing strip 14 and apply the labels, one at a time, to a desired surface 16 on an article 18. The labels 12 may preferably be applied when the articles 18 are at a labeling station 20.

The labeling station 20 is a location to which each of the articles 18 to be labeled is moved as depicted by an arrow 22. The articles 18 and other articles, may be moved for this purpose by a variety of means and devices, such as a conveyor 24. The conveyor 24 may be of various different constructions including roller beds or fluid channels, for example. However, any suitable technique for moving articles 18 to the labeling station 20 may be used. A hold down device (not shown) may be used to hold each article 18 on the conveyor 24.

A sensor 26 may be provided to detect and locate each of the articles 18 as they move into the labeling station 20. This is particularly useful when using a continuous motion, article delivery system. The sensor 26 may include a photodetector device or similar device as is generally known in the art. As the article 18 is detected by the sensor 26, an electrical signal or other communication is produced according to known techniques for use in activating the label applicator so that a label 12 is applied to the article 18.

The labels 12, which may also include source tags and similar devices, may be supplied in a spaced apart fashion along the backing strip 14. Generally, each label 12 includes a lower surface or bottom face 28 and an opposing upper face 30. The bottom face 28 is supplied with a pressure sensitive adhesive 32 which is releasably adhered to the backing strip 14. The backing strip 14 may be coated with a release agent to prevent the labels 12 from adhering too strongly. The backing strip 14 may be supplied as a roll or an elongated strip.

Figure 2:
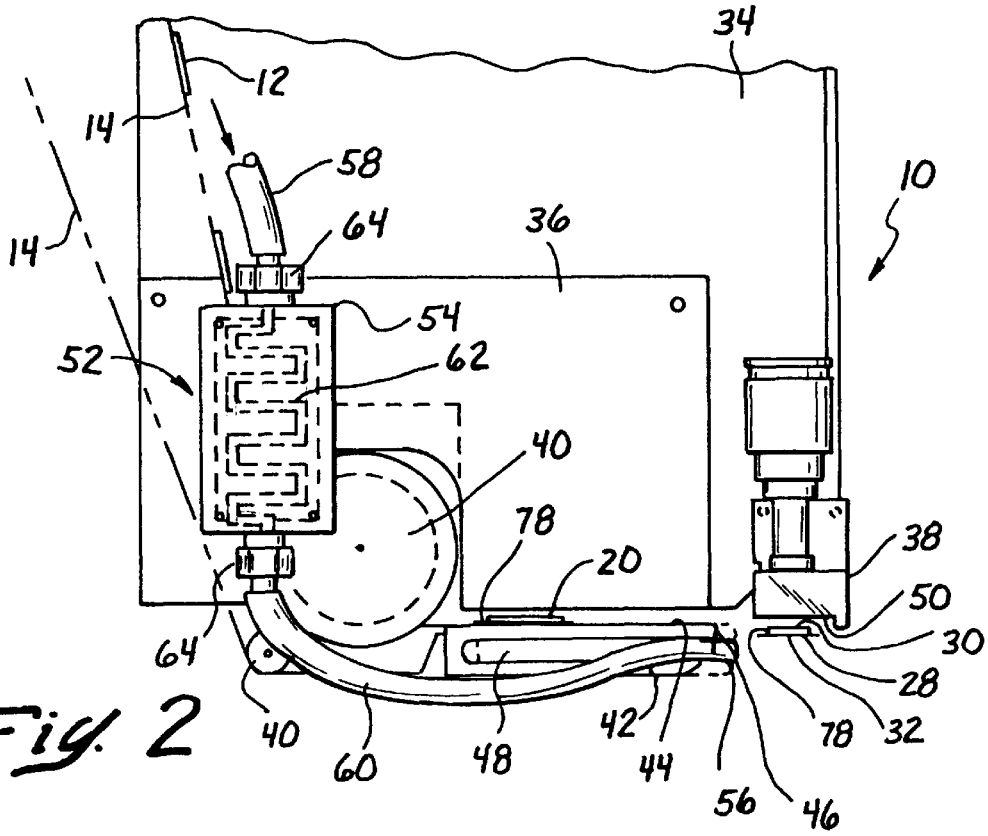
FIG. 2 is a side view of an embodiment of a label dispenser having a gas dispenser constructed in accordance with the principles of the present invention.
Figure 3:
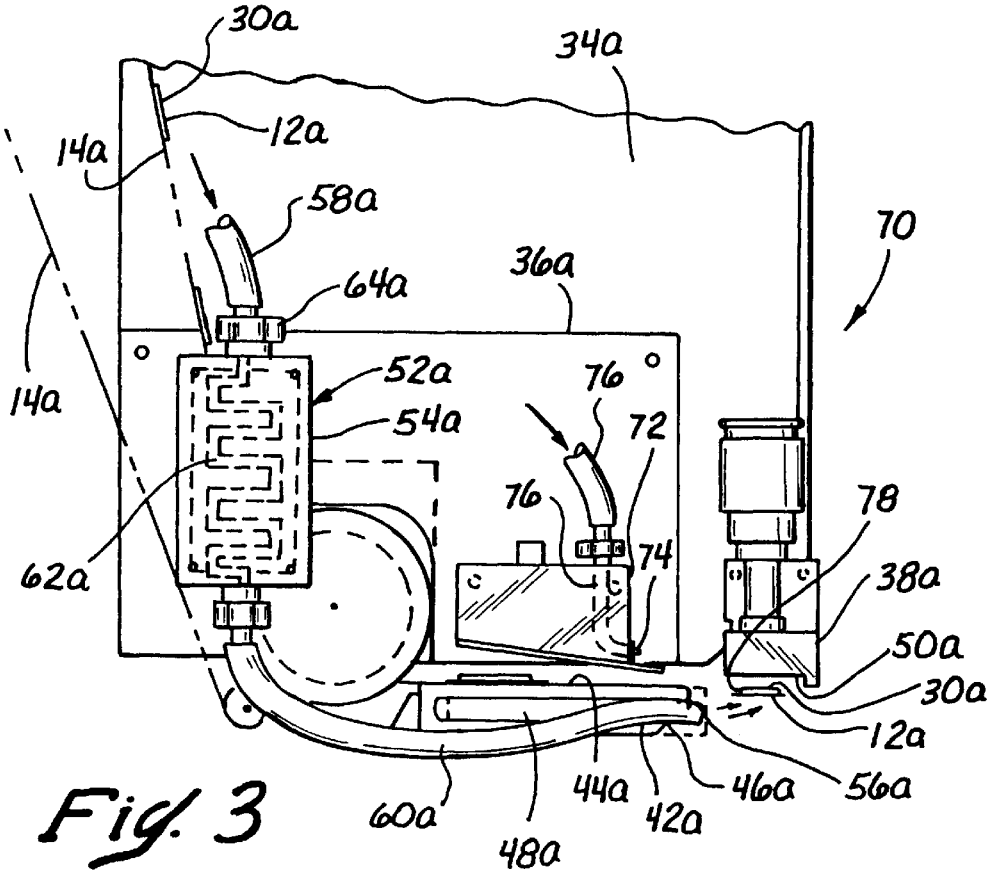
FIG. 3 is a partial side view of an alternative embodiment of a label dispenser according to the present invention.

Referring now to FIGS. 1 through 3, the hot gas label applicator 10 includes a housing or other supporting structure 34 on which is mounted a label dispenser 36 and a movably mounted label receiver 38. The supporting structure 34 may be of any conventional or similar construction. The label receiver 38 is generally located in a predetermined relationship to the labeling station 20 where each label 12 is generally applied to the desired surface 16 on the article 18.

The label dispenser 36 may be of various different forms and embodiments. However, in the preferred embodiment as illustrated, the label dispenser 36 is adapted for use with labels 12 having a relative thickness and having at least one layer of the pressure sensitive adhesive 32 applied to the lower surface or bottom face 28. Preferably, these labels 12 will have a minimum thickness of approximately 0.025 inches. Such labels 12 may include source tags such as those of the type manufactured by Sensomatic in Deerfield Beach, Florida. However, similar labels, source tags, or other security labels and tags may also be dispensed and transferred using the present label dispenser 36. The various tags and labels as described may also be provided in varying sizes. It is to be understood that the label applicator 10 of the present invention encompasses being adapted for use with the various types, shapes and sizes of labels.

Generally and in broad terms, the label dispenser 36 may include an arrangement of rollers 40 and a peeler bar 42 having a peeler plate or peeling surface 44 and a peeling edge or tip 46. At least one of the rollers 40 may be driven by a motor (not shown) to move the elongated backing strip 14 from a supply reel 41 to the label dispenser 36. In particular, the backing strip 14 may be moved a predetermined distance around the peeler bar 42 such that the backing strip 14 moves over the peeling surface 44 and around the peeling edge 46. This incremental movement sequentially separates each of the labels 12 from the backing strip 14.

A peeler bar heater 48 is preferably coupled to the peeler bar 42 for heating the peeling surface 44. Preferably, the peeler bar heater 48 is disposed adjacent to and below the peeling surface 44 so as to directly conduct heat into the peeling surface 44. The heated peeling surface 44 directly transfers heat into the labels 12 as they are moved over the peeling surface 44. This heat softens the adhesive layer 32 on each label 12, increases tackiness and facilitates their adhesion to the articles 18.

The heating element 48 is configured and sized to heat the peeling surface 44 sufficiently such that the adhesive layer 32 on each label 12 is softened but not over-softened. In particular, if the adhesive layer 32 on each label 12 receives too much heat, the label 12 may be difficult to remove from backing strip 14 and, in some cases, the adhesive may be prematurely activated.

Preferably, the peeling surface 44 is heated to a temperature between approximately 80 degrees F. and approximately 130 degrees F. However, different applications may require more or less heat and potentially, a greater or lesser peeling surface 44 temperature. The necessary temperature of the peeling surface 44 will generally depend on the production speed of the label applicator 10, the type of adhesive 32 on the labels 12 and the size of the labels 12, among other variables.

Preferably, the peeler bar heater 48 comprises an electrical resistance heating element, preferably having a power rating of between 4 Watts and 35 Watts and more preferably about 15 Watts when disposed within the peeler bar 42. Such a heating element may include, for example, heating element C1010-15/120 by Vulcan Electric Company. However other types, sizes and configurations of heaters may also be used.

As each label 12 is peeled or otherwise removed from the backing strip 14, it is moved off of the label dispenser 36 and transferred onto the label receiver 38.

Specifically, each label 12 may be dispensed from the label receiver 36 onto a receiving surface or label receiving faces 48 on the label receiver 38. Typically, the label receiving face 50 generally faces downward and towards the surface 16 of the article 18. The label receiving face 50 may be planar or alternatively, may be of different constructions and orientations.

To facilitate the transfer of labels 12 from the label dispenser 36 to the label receiving face 50, the peeling surface 44 may be inclined with respect to the horizontal. However, depending upon the construction and orientation of the label dispenser 36 and the label receiver 38, these orientations may also be varied.

Vacuum pressure from a separate source may be drawn through openings within the label receiver 38 and the label receiving face 50 to releasably retain the label 12 against the label receiving face 50. Once the label 12 is positioned on the label receiving face 50, it may be transported by the label receiver 38 to the desired surface 16 of the article 18. The label 12 may be applied to the article 18 by a blast of air and/or by tamping the label 12 onto the desired surface 16 of the article 18.

A hot gas dispenser 52 is advantageously used to facilitate the attachment of each label 12 to the article 18. The hot gas dispenser 52 may include a gas heater 54 to heat a supply of a pressurized gas which may then be directed against the labels 12. A nozzle 56 or a plurality of nozzles may be used to direct and discharge a flow of the heated gas against each label 12 as the labels move past the peeling edge 46. The hot gas warms the adhesive layer 32, on each label 12 and increases the tackiness of the adhesive 32 as previously described.

In the embodiment illustrated, the hot gas dispenser 52 is incorporated as apart of the label dispenser 36 and thus, is attached to the supporting structure 34. The hot gas dispenser 52 is fluidly interconnected through at least one passageway 58 with the supply of pressurized gas. Preferably, this gas is compressed air, such as from a pneumatic compressor. However other types of compressed gas may be used. The pressure of the supplied gas may be relatively low, and may be varied depending upon the desired heat transfer and other effects, as will be described further below.

The pressurized gas flows through the gas heater 54, where it is heated, and then flows out of the nozzles 56. A second passageway 60 fluidly interconnects the gas heater 54 and the nozzles 56. Preferably, the passageways 58 and 60 may comprise pneumatic tubing, such as ¼ inch Polyethylene tubing having an inner diameter of approximately ⅛ inch. however, hard tubing, machined passageways or any other type of passageway may also be used.

The nozzle 56 is preferably oriented to direct the flow of gas against the adhesive layer 32 on each label 12. The flow of gas may be directed directly against the label lower or bottom face 28, but is preferably directed towards the dispensing label 12. In this way, a large quantity of heat transfer takes place while facilitating the movement of the label 12 against the label receiving face 50.

Preferably, the nozzles 56 are attached to the label dispenser 36 or alternatively, the peeling bar 42. The nozzles may be positioned adjacent to and just below the peeler bar 42 such that the hot gas is dispensed against the bottom face 28 of each label 12 as the label 12 is moved past the peeling edge 46 and transferred onto the label receiving face 50. The nozzles 56 may even be incorporated as integral part of the peeler bar 42.

The gas heater 54 may include a electrical heating element 62 such as a resistive heating element, as best illustrated in FIG. 3. The flow of pressurized gas is directed through the passageway 58 and into the gas heater 54 where the heating element 62 transfers heat into the gas. The heated gas is then directed to the nozzles 56 through the second passageway 60. Tube fittings 64 or the like may be used to couple the passageways 58 and 60 to the gas heater 54.

An advantage of the present hot gas dispenser 52 is that it may be readily incorporated into air assist systems on existing label applicators. Thus, the hot gas dispenser 52, may be used to soften and increase the tackiness of the adhesive layer 32 on each label 12 as well as to facilitate the transfer and retention of each label against the label receiving face 50.

The gas heater 54 may be sized to sufficiently heat the flow of gas such that the adhesive layer 32 on each label 12 is softened, as previously described. It is important that the adhesive is not over-softened or liquefied, as to reduce it strength or cause other problems. The sizing of the gas heater 54 will depend upon the size of the label 12 and the adhesive layer 32 as well as the labeling production speed. In addition, the quantity, temperature, pressure and impact orientation of the gas on the labels 12 will also affect this sizing, among other variables. Preferably, the gas heater will increase the temperature of the ambient pressurized gas from approximately 78 degrees F. to approximately 120 degrees F. However, higher temperatures may be needed.

In a preferred embodiment, the label applicator 10 includes a label dispenser 36 having both a peeler bar heater 48 and a hot gas dispenser 52. In this embodiment, heat may be evenly transferred to the adhesive layer 32 without requiring a high temperature peeling surface 44 or high temperature or pressure gas distribution.

As an example, when applying 0.420 inch by 1.78 inch source tags by Sensomatic, at production speeds of approximately 500 labels per minute, a preferable configuration includes a 7–8 Watt peeler bar heater 48, such as cylindrical heating element C1010 by Vulcan Electric Co. and a low wattage gas heater 54, such as Label-Aire design assembly P065740 gas heater by Label-Aire, Inc. This configuration generally heats the peeling surface 44 to a temperature of approximately 92 degrees F and the supply of pressurized gas is heated from a ambient temperature of approximately 78 degrees F. to an exiting temperature of approximately 106 degrees F.

Referring now to FIG. 3, an alternative embodiment of a label applicator constructed in accordance with the principles of the present invention is shown. In this embodiment, like features to those of the previous embodiment are designated by like reference numerals, succeeded by the letter "a". As shown, the label applicator 70 includes a label dispenser 36*a* as previously described. However, a second gas dispenser or air assist 72 may be attached to the supporting structure 12*a* or alternatively, the label dispenser 36*a*. The second gas dispenser 72 may be used to assist in moving the label 12*a* off of the peeler bar 42*a* and onto the label receiving face 50*a*.

The second gas dispenser 72 may include a second nozzle or plurality of nozzles 74 which are fluidly connected through a passageway 76 with a second supply of a pressurized second gas. The passageway 76 may comprise pneumatic tubing or machined passageways, as previously described. The second nozzle 74 may be oriented such that the second flow of gas is directed against the upper face 30*a* and the rear portion 78 of each label 12*a* as the label 12*a* is transferred from the label dispenser 36*a* to the label receiver 38*a*. Such a second gas dispenser 72 is further described in co-pending U.S. patent application Ser. No. 08/833,967, filed Apr. 11, 1997, and entitled, *Improved Label Applicator*, which is herein expressly incorporated by reference.

Preferably, the second supply of the second pressurized gas is pressurized air. Thus, the first pressurized gas and the second pressurized gas may be from the same supply. However, different gases and different supplies may also be used.

This also allows the first and second supplies of gas to be provided at differing pressures. Pressure regulators or even restrictive nozzles may also be used to control discharge pressures.

Referring now to FIGS. 1–3, a method of applying labels using a label applicator device will be described. The method, which applies labels 12, having an adhesive 32 on at least one face 28, to a surface 16 of an article 18, includes the step of providing a label applicator device such as the label applicator 10 of the present invention. The labels 12 are supplied to the label applicator 10 in a spaced apart fashion on a backing strip 14.

The provided label applicator device 10 includes a label dispenser 36 with a peeler bar 42 for removing labels 12 from the backing strip 14 and transferring the labels 12 to a label receiver 38. The label dispenser 36 also includes a hot gas dispenser 52 having at least one nozzle 56 coupled adjacent the peeler bar 42.

The method includes the step of supplying labels 12 to the label dispenser 36. The supplied labels 12 are then removed, one at a time, from the backing strip 14 as previously described. The removed labels 12 are dispensed from the label dispenser 36 and transferred onto the label receiver 38. The hot gas dispenser 52 is used to heat a flow of pressurized gas and to dispense the heated gas against each label 12 as the label 12 is transferred from the label dispenser 36 onto the label receiver 38. The hot gas soften the adhesive 32 on the label face 28 as previously described. Once the label 12 is transferred to the label receiver 38, a blast of a second gas may be applied through the label receiver 38 and against the label 12 to remove the label 12 from the label receiver 38 and transfer the label 12 to the surface 16 of the article 18.

The method may also include providing the label dispenser 36 with a peeler bar 42 having a peeling surface 44 and peeling edge 46 as previously described.

The peeling surface 44 may then be heated as the backing strip 14 is slidably moved across the peeling surface 44 to heat the labels 12 and further soften and increase the tackiness of the adhesive layer 32. This step may include energizing the peeler bar heater 48 to conductively heat the peeling surface 44. Preferably, the method includes maintaining the peeling surface 46 between a temperature of approximately 85 degrees F and approximately 150 degrees F. A sensor or other feedback type system may be incorporated into the peeler bar 44 to regulate the peeler bar heater 48 and maintain the peeling surface 46 temperature.

While this invention has been described with respect to various specific examples and embodiments, it is to be understood that various modifications may be made without departing from the scope thereof For example, various sizes of the label applicator device and particularly, the label dispensing device are contemplated as well as various types of construction materials. Also, various modifications may be made to the configuration of the parts and their interaction. Therefore, the above description should not be construed as limiting the invention, but merely as an exemplification of preferred embodiments thereof and that the invention can be variously practiced within the scope of the following claims.

What is claimed is:

1. A label applicator for removing labels from an elongated backing strip and for applying at least one of the labels to a surface on an article, said label applicator comprising:

a supporting structure;

a label receiver movably mounted to the supporting structure, said label receiver having a label receiving face for releasably refraining a label;

a label dispenser attached to the supporting structure for removing at least one label having am adhesive layer thereon from the backing strip and for transferring the label onto the label receiving face, said label dispenser comprising a peeler bar having a peeling surface over which the backing strip can be drawn for removing the label from the backing strip; and a hot gas dispenser attached to the supporting structure and in fluid connection with a supply of a pressurized gas, said hot gas dispenser comprising a heater for heating the gas, a nozzle for discharging the heated gas, and a passageway fluidly connecting the supply of gas with the heater and the nozzle, the nozzle being an integral part of the peeler bar and being positioned to discharge the heated gas between the label dispenser and the label receiver, so that the heated gas is discharged against the adhesive layer on said label after the label has been removed from the backing strip and before it has been deposited onto the label receiving face;

wherein the label receiver is adapted to transfer a label retained thereon to the surface on the article.

2. The label applicator as recited in claim 1 wherein the heater comprises an electrical resistive heating element.

3. The label applicator as recited in claim 1 wherein the nozzle comprises a plurality of nozzles and wherein each of said nozzles is oriented such that the gas is at least partially directed against an adhesive layer on a face of said label.

4. The label applicator as recited in claim 1 wherein the gas is air.

5. The label applicator as recited in claim 1, and further comprising a peeler bar heater coupled to the peeler bar for heating the peeling surface.

6. The label applicator as recited in claim 5 wherein the peeler bar heater comprises an electrical resistive beating element and wherein said peeler bar beater is disposed adjacent said peeling surface.

7. The label applicator as recited in claim 6, wherein the second electrical resistive heating element has a power rating of between approximately 5 watts and approximately 35 watts.

8. The label applicator as recited in claim 6, wherein said second electrical resistive heating element heats the peeling surface to a temperature of between 85 degrees F. and 120 degrees F.

9. The label applicator as recited in claim 1, and further comprising a second gas dispenser attached to the supporting structure at a location spaced from said hot gas dispenser, said second gas dispenser including a second nozzle fluidly connected through a second passageway with a supply of a pressurized second gas, said second nozzle being oriented such that said second gas assists in transferring a label from said backing strip to said label receiver.

10. A label applicator for removing labels from an elongated backing strip and for applying at least one of the labels to a surface on an article, said label applicator comprising:

a supporting structure;

a label receiver movably mounted to the supporting structure, said label receiver having a label receiving face for releasably retaining a label;

a label dispenser attached to the supporting structure for removing at least one label from the backing strip and for transferring the label onto the label receiving face, the label dispenser further comprising a peeler bar having a peeling surface over which the backing strip can be drawn for removing the label from the backing strip; and a hot gas dispenser attached to the supporting structure and in fluid connection with a supply of a pressurized gas, said hot gas dispenser comprising a heater for heating the gas, a nozzle for discharging the heated gas against the label being transferred onto K the label receiving face, and a passageway fluidly connecting the supply of gas with the heater and the nozzle, the nozzle comprising an integral part of said peeler bar;

wherein the label receiver is adapted to transfer a label retained thereon to the surface on the article.

11. A label applicator for removing labels from an elongated backing strip and for applying at least one of the labels to a surface on an article, said label applicator comprising, a supporting structure;

a label receiver movably mounted to the supporting structure, said label receiver having a label receiving face for releasably retaining a label having an upper surface and a lower surface;

a label dispenser attached to the supporting structure for removing at least one label having an adhesive layer on said lower surface from the backing strip and for transferring the label onto the label receiving face;

a hot gas dispenser attached to the supporting structure and in fluid connection with a supply of a pressurized gas, said hot gas dispenser comprising a heater for heating the gas, 4 nozzle the discharging the heated gas, and a passageway fluidly connecting the supply of gas with the heater and the nozzle, The nozzle being positioned to discharge the heated gas against the adhesive layer on said label before it has been deposited onto the label receiving face; 4and an unheated gas dispenser attached to The supporting structure at a location spaced from said hot gas dispenser, said unheated gas dispenser including a second nozzle fluidly connected through a second passageway with a supply of a pressurized unheated gas, said second nozzle being oriented such that said unheated gas is directed toward said upper label surface before the label has been deposited onto the label receiving face and assists in transferring the label from said backing strip to said label receiver;

wherein the label receiver is adapted to transfer a label retained thereon to the surface on the article.

12. A method of applying a label having an adhesive on at least one face to a surface on an article, the method comprising The steps of:

providing a label applicator having a label dispenser with a peeler bar for removing at least one label from a backing strip and transferring the label to a label receiver, the label dispenser further including a hot gas dispenser adjacent to the peeler bar;

supplying the label to the label dispenser;

dispensing the label from the label dispenser toward the label receiver;

discharging a flow of a hot gas from the hot gas dispenser against an adhesive layer on a lower surface of the label as the label travels from the label dispenser to the label receiver to soften the adhesive thereon; and applying a second flow of unheated gas against an upper surface of the label as the label travels to the label receiver to assist in proper placement and retention of the label on the label receiver.

13. The method as recited in claim 12 wherein the step of providing a label applicator further comprises providing a label dispenser having a peeler bar with a peeling surface and wherein the step of dispensing the label comprises slidably moving a backing strip supporting the label across the peeling surface to remove the label from the backing strip.

14. The method as recited in claim 13 and further comprising the step of heating the peeling surface as the backing strip is moved across the peeling surface.

15. The method as recited in claim 14 wherein the step of heating the peeling surface comprises maintaining the peeling surface at a temperature of between 85 degrees F. and 140 degrees F.

16. The method as recited in claim 14 wherein the step of heating the peeling surface comprises energizing a heating element attached to the peeler bar to conductively heat the peeling surface.

17. The method as recited in claim 12 and further comprising a step of applying a blast of a second gas through the label receiver and against the label to remove the label from the label receiver and to transfer the label to the surface of the article.

* * * * *